United States Patent [19]

Wirz

[11] 4,090,702

[45] May 23, 1978

[54] SUCTION AIR CONTROL DEVICE FOR USE WITH SHEET FEEDS

[75] Inventor: Arno Wirz, Bammental, Germany

[73] Assignee: Heidelberger Druckmaschinen AG, Heidelberg, Germany

[21] Appl. No.: 695,439

[22] Filed: Jun. 14, 1976

Related U.S. Application Data

[63] Continuation of Ser. No. 535,691, Dec. 23, 1974, abandoned, which is a continuation of Ser. No. 352,192, Apr. 18, 1973, abandoned.

[30] Foreign Application Priority Data

Apr. 26, 1972 Germany ..... 2220469

[51] Int. Cl.[2] ..... B65H 3/08

[52] U.S. Cl. ..... 271/108; 271/96

[58] Field of Search ..... 271/108, 96; 92/118

[56] References Cited

U.S. PATENT DOCUMENTS

| | | | |
|---|---|---|---|
| 1,747,809 | 2/1930 | Aldrich | 271/96 |
| 2,670,203 | 2/1954 | Banthin | 271/108 |
| 2,844,368 | 7/1958 | Dexter et al. | 271/108 X |

*Primary Examiner*—Bruce H. Stoner, Jr.
*Attorney, Agent, or Firm*—Herbert L. Lerner

[57] ABSTRACT

A suction air control device used in conjunction with feed tables for feeding individual sheets in paper processing machines is arranged between a source of vacuum and a sheet feed suction bar. The device incorporates the use of a three-way valve which may be controlled by electric switching pulses, for example, in response to movement of the main operating lever or response to a monitoring device for monitoring double and incorrectly fed sheets in the event two sheets are disposed on top of each other or a sheet is disposed at an angle.

2 Claims, 2 Drawing Figures

SUCTION AIR CONTROL DEVICE FOR USE WITH SHEET FEEDS

This is a continuation of application Ser. No. 535,691, filed Dec. 23, 1974, which in turn, is a continuation of Ser. No. 352,192, filed Apr. 18, 1973, both now abandoned. This invention relates to a suction air control device which is used in conjunction with feed tables for feeding individual sheets in paper-processing machines and which is arranged between a vacuum generator and a sheet feed suction bar.

It is an object of the present invention to effectively control the air in a sheet feed suction bar with simple means and which makes it possible to intervene or introduce by means of electrical commands, various functions, as required, outside of the functions determined by the main operating lever.

The present invention consists of providing a three-way valve having one output connected to a line leading from the vacuum generator to the sheet feed suction bar, a second output which is sealed by a valve shutter which is controlled by an electromagnet, and a third output which is closed by a valve cover which, in turn, is controlled in synchronism with the operation of the machine. With such a three-way valve, which can be manufactured simply and inexpensively, the suction can be controlled extremely effectively via electric switching pulses at the moment of the sheet transfer as well as on special occasions.

The electric switching pulses may be generated by means of a main operating lever, for example, when starting and stopping the machine. Such switching pulses can, furthermore, be generated by a monitoring device for monitoring double and incorrectly fed sheets in the event that two sheets are disposed on top of each other or a sheet is disposed at an angle. Finally, a separate toggle switch may be provided to transmit to the electromagnet, for example, a switching pulse for closing the three-way valve if a paper run without moistening is desired.

In an advantageous further embodiment of the invention, the vacuum generator is designed as a piston air pump and is mounted to be pivoted on a bracket which is attached to a housing. The oscillating motion of the air pump, which occurs in synchronism with the operation of the sheet feed, is used for controlling operation of the valve cover. The direct control of the valve cover by the oscillating piston air pump makes the otherwise customary intermediate members unnecessary.

Other features which are considered as characteristic for the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection wtith the accompanying drawings, in which.

Figure 1:
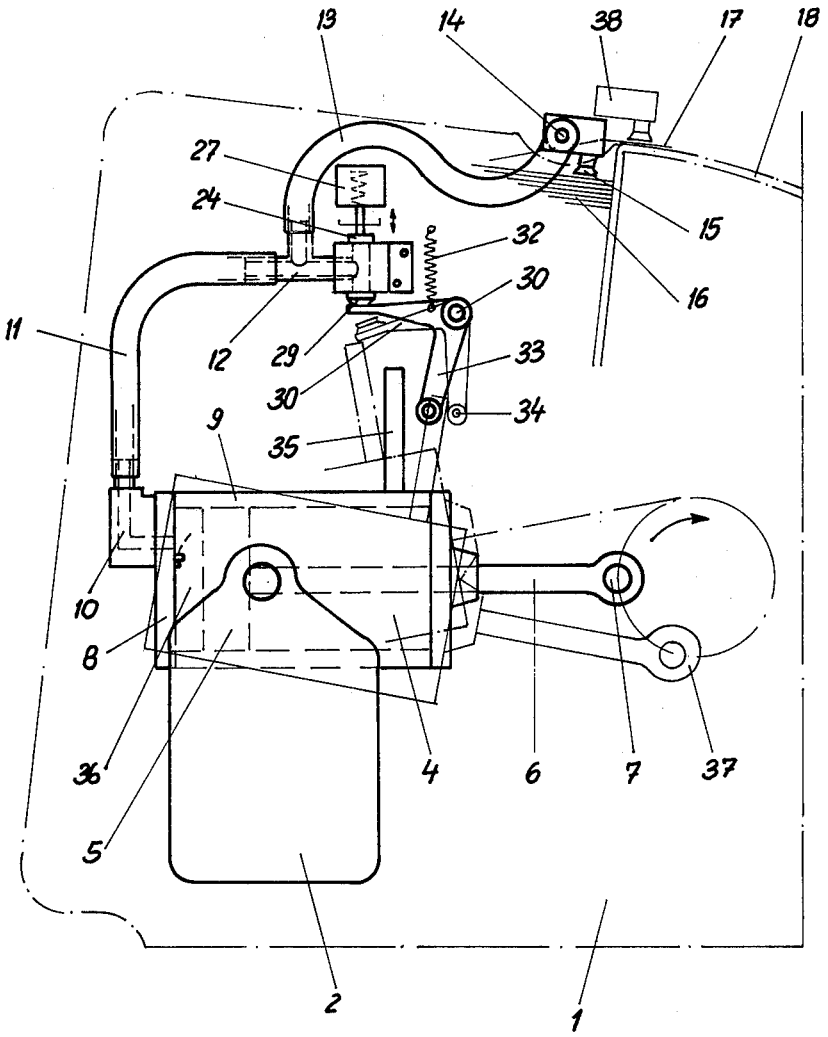
FIG. 1 is an elevational view looking at the side wall of a suction air control device for use with sheet feeds according to one embodiment of the invention.
Figure 2:
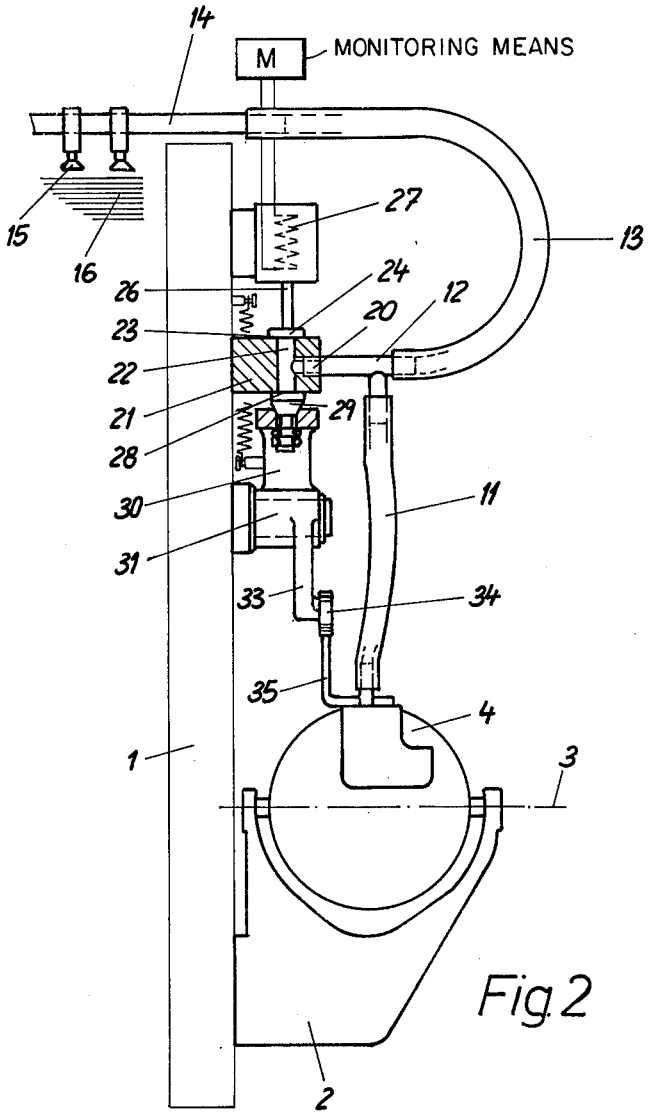
FIG. 2 is an elevational view as seen parallel to the side wall of the suction air control device shown in FIG. 1.

Referring to the drawings, there is shown a sidewall 1 of a sheet feed to which is attached a bracket 2. A piston air pump 4 is attached to the bracket and the piston air pump 4 can swing about a horizontal axis 3. The piston air pump 4 has a piston 5 which is linked via a piston rod 6 to a crank pin 7. The crank pin 7 is driven at a 1:1 rate or ratio. The cylinder 9 of the piston air pump 4 has a rear end wall 8 on which is mounted a suction-air connection 10 onto which is pushed or received one end of an air hose 11. The other end of the air hose 11 is connected to a distributor member 12. From the distributor member 12 a further air hose 13 leads to a suction bar 14 having suction cups 15 which always lift one sheet 17 off of a feed pile 16, transport it to the height of a feed table 18, and then transfer it to the grippers of a sheet feed (not shown).

One connection end of the distributor member 12 leads to one output 20 of a three-way valve 21. The output 20 is in the form of a hole or passage which opens into another hole or passage 22 extending transversally thereto. The upper end of the transverse hole or passage 22 constitutes a second output 23 of the three-way valve 21 and is closed off by a valve shutter 24.

The valve shutter 24 is rigidly connected to an electromagnet 27 through a rod 26. The electromagnet 27 is operable to lift the valve shutter 24 through the rod 26 and to lower it again to cover the second output 23 of the three-way valve 21. The electromagnet 27 is controlled by a monitoring device (not shown) for monitoring double-fed and angel-fed sheets and by a switch (also not shown) by means of which the sheet feed can be switched on or off as required. The electromagnet 27 can furthermore be operated independently of the electromechanical printing start and stop arrangement by means of a toggle switch (not shown).

The lower opening of the transverse hole or passage 22 of the three-way valve 21, constitutes a third output 28 which is closed off by a valve cover 29. The valve cover 29 is attached to the free end of a lever arm 30 of a double-lever 31 fulcrumed on the side wall 1. To the same lever arm 30 is also hooked a tension spring 32 which always pulls or biases the lever arm 30 upwardly, and thus biases the valve cover 29 against the third output 28 of the three-way valve 21. A rotatable roller 34 is attached to the other arm 33 of the double-lever 30. A switching bar 35 which is attached to the cylinder 9 of the piston air pump 4 contacts the roller 34 and actuates the double lever 31. The switching bar 35 thus strikes the roller 34 in synchronism with the operation of the machine.

The operation of the above described device follows. Upon rotation of the crank pin 7 which rotates with a 1:1 ratio, the space 36 between the piston 5 and the end wall 8 of the cylinder 9 is increased as the piston rod 6 rotates along a rotary movement of 180°. Thus, during the period, air is drawn in, that is, a vacuum is generated. This vacuum is propagated or transmitted via the air hose 11, the distributing member 12, and the air hose 13 up into the suction bar 14 and the suction cups 15. As a result, a sheet 17 is drawn up and lifted.

As the crank pin 7 continues to rotate further to the lightly-drawn position 37 of the piston rod 6 as shown in FIG. 1, the suction bar 14 has also moved to the likewise lightly-drawn position 38 shown in FIG. 1. The drawn-up or lifted sheet 17 has therefore been moved onto the feed table and to the sheet transport means which transports it for further handling in the last described position. The switching bar 35 has swung the double-lever 30 counterclockwise sufficiently so that the valve cover 29 is lifted off of the third output 23 of the three-way-valve 21. A connection to the atmosphere is thereby established and this allows the vacuum generated by the piston air pump 4 to be broken due to the introduction of fresh air, into the valve 21, whereby the suction cups 15 release the transported and transferred sheet 17. Upon further rotation of the crank pin 7, the switching bar 35 again is lifted off of the roller 34. Thereby the tension spring 32 is free to swing the double-lever 30 clockwise and to press the valve cover 29 against the third output 28 of the three-way valve 21.

If the monitoring device M for double-fed and angle-fed sheets ascertains that two sheets have been picked up or a sheet has been transferred obliquely, the machine is stopped and the valve cover 24 is lifted via the electromagnet 27. Thus it will be seen that even during the suction period of the piston air pump 4, that is, during the sheet transport by the suction bar 14, the suction line 11, 12, 13 is immediately vented and the sheet drops off of the suction cups 15. During the subsequent coasting or slowing down of the machine, no further sheets are picked up and fed to the printing machine. The electromagnet 27 receives a short electric pulse which initiates the lifting of the valve shutter 24. When the machine is started again, the valve shutter 24 is then again pressed firmly on the second output 23 of the three-way valve 21.

The main operating lever (not shown) for the machine has at least four switch positions as follows:

1. "Off": The machine is completely stopped;
2. "Operation": the machine runs without feeding sheets;
3. "Paper Run": sheets are fed with the moistening device operable;
4. "Print": the rubber cylinders are placed in the printing position.

If the main operating lever is put in the 3rd "Paper Run" position, the electromagnet 27 receives a switching pulse, and the three-way valve 21 is closed by means of the valve shutter 24. The uppermost sheet of the supply pile 16 is thereby drawn up immediately.

With the paper run now starting and operating, the sheets are moistened by the likewise operable moistening mechanism (not shown). If a paper run without moistening is desired, a toggle switch (not shown) is operated with the main operative lever in the 2nd position "Operation". The switching pulse generated thereby causes the valve shutter 24 likewise to drop to the second output of the three-way valve 21 via the electromagnet 27 and sheet feeding starts.

The use of the three-way valve 21 in conjunction with the electromagnet 27 allows a multiplicity of switching possibilities, independently of the position of the main operating lever. This facilitates operation and the margin of safety against damage of the machine parts is increased.

What I claim is:

1. A suction air control device for use with sheet feeds feeding individual sheets in a paper processing machine comprising a suction bar means operable to lift a sheet and feed the latter, a vacuum generator means, conduit means including a three-way valve between said vacuum generator means and said suction bar means, said conduit means having a conduit section extending between said vacuum generator means and said suction bar means, said three-way valve having a first passage in communication with said conduit section, said three-way valve having a second passage and a third passage, said first, second and third passages of said three-way valve being in communication with one another, at all times, a first valve operator means connecting said second passage to atmosphere upon command, and a third valve operator means connecting said third passage to atmosphere in synchronism with the operation of said machine, said machine having a housing, said vacuum gnerator means comprising a piston operable in a cylinder, means pivotally mounting said cylinder on said housing, means reciprocating said piston within said cylinder whereby reciprocation of said piston in said cylinder causes said cylinder to oscillate, said cylinder oscillating in synchronism with the operation of said machine and means connected to said cylinder for controlling the operation of said third valve operator.

2. A suction air control device according to claim 1 wherein said means actuated by said oscillating cylinder includes a bell crank lever pivotally mounted on said housing, means biasing said bell crank lever to dispose said third valve operator in a position to close said third passage, and means on said cylinder to rotate said bell crank lever against the bias of said biasing means.

* * * * *